United States Patent [19]

Cunningham et al.

[11] 4,431,066

[45] Feb. 14, 1984

[54] STRESSED RELIEVED BIT LEG FOR AN EARTH BORING BIT

[75] Inventors: Robert A. Cunningham, Bellaire; George E. Dolezal, Friendswood, both of Tex.

[73] Assignee: Hughes Tool Company, Houston, Tex.

[21] Appl. No.: 235,481

[22] Filed: Feb. 18, 1981

[51] Int. Cl.[3] ..... E21B 10/08

[52] U.S. Cl. ..... 175/372; 175/331

[58] Field of Search ..... 175/369–372, 175/331, 374, 375; 308/4 A

[56] References Cited

U.S. PATENT DOCUMENTS 3,739,864 6/1973 Cason, Jr. ..... 175/372

4,077,428 3/1978 Ioannesian ..... 175/372

*Primary Examiner*—William F. Pate, III

*Attorney, Agent, or Firm*—Robert A. Felsman; James E. Bradley

[57] ABSTRACT

An earth boring bit has features to reduce stress concentration. The earth boring bit is of the type having three bit legs, each bit leg having a depending bearing pin for rotatably carrying a cutter. An annular fillet is formed at the junction of the bearing pin and the bit leg for receiving a seal ring. To relieve stress above the fillet and on the inside surface of the bit leg, a depression is formed. The depression is formed in the inside surface of the bit leg with a lower edge commencing at the top of the fillet. The depression is curved in vertical cross-section and is located behind the backface of the cutter.

4 Claims, 3 Drawing Figures

STRESSED RELIEVED BIT LEG FOR AN EARTH BORING BIT

BACKGROUND OF THE INVENTION

This invention relates in general to earth boring bits, and particularly to features for reducing stress concentration between the bit legs and cutter bearing pins.

The most common earth boring bit for drilling relatively small diameter wells, such as oil and gas wells, have three rotatable cutters. Each cutter is mounted on a bearing pin that depends downwardly from a bit leg. During drilling, very large downward forces are exerted on the drill bit. This creates a high stress area at the junction of the bit leg with the bearing pin. Stress cracks may result on the inside of the bit leg and on the nonpressure or upper side of the bearing pin. This may result in shortening the life of the bit, and also result in having to fish out of the well broken components from the drill bit.

One type of bit uses a friction or journal bearing. In this type of bit, a flat annular surface is formed on the inner surface of the bit leg surrounding the cylindrical bearing pin. This annular surface, known as the "last machined surface", may be flush with the inside surface of the bit leg or part may be recessed into a groove. The last machined surface is located in a plane parallel with the plane of the cutter backface. The backface is an annular surface surrounding the cavity of the cutter, and located in a plane normal to the cutter axis.

The journal bearing bit of the prior art type normally uses an O-ring seal located in a fillet or seal boss formed at the intersection of the bearing pin and last machined surface. The area on the upper side at the bit leg—bearing pin juncture experiences the high stresses that are likely to result in cracks. The radius of the seal boss fillet is small, but cannot be increased substantially to reduce stress concentration, since it must equal the cross-sectional radius of the O-ring.

Also, in the prior art journal bearing bit, the section increases abruptly above and below the bit leg—bearing pin juncture. This abrupt change in section increases stress concentration at this point of juncture.

SUMMARY OF THE INVENTION

In this invention, improvements are made to the bit to reduce the stress concentration at the junction of the bearing pin with the bit leg. A groove or depression is formed above the junction of the bearing pin and bit leg for reducing stress concentration. This removal of material reduces the abrupt change in cross-section, which redistributes the stresses over a larger area lowering peak values.

In the preferred embodiment, the groove is formed on the inside of the leg immediately above and adjacent to the seal boss. This groove is curved in cross-section, and extends upwardly to a point near the crotch area of the bit.

DESCRIPTION OF THE PREFERRED EMBODIMENT

Figure 1:
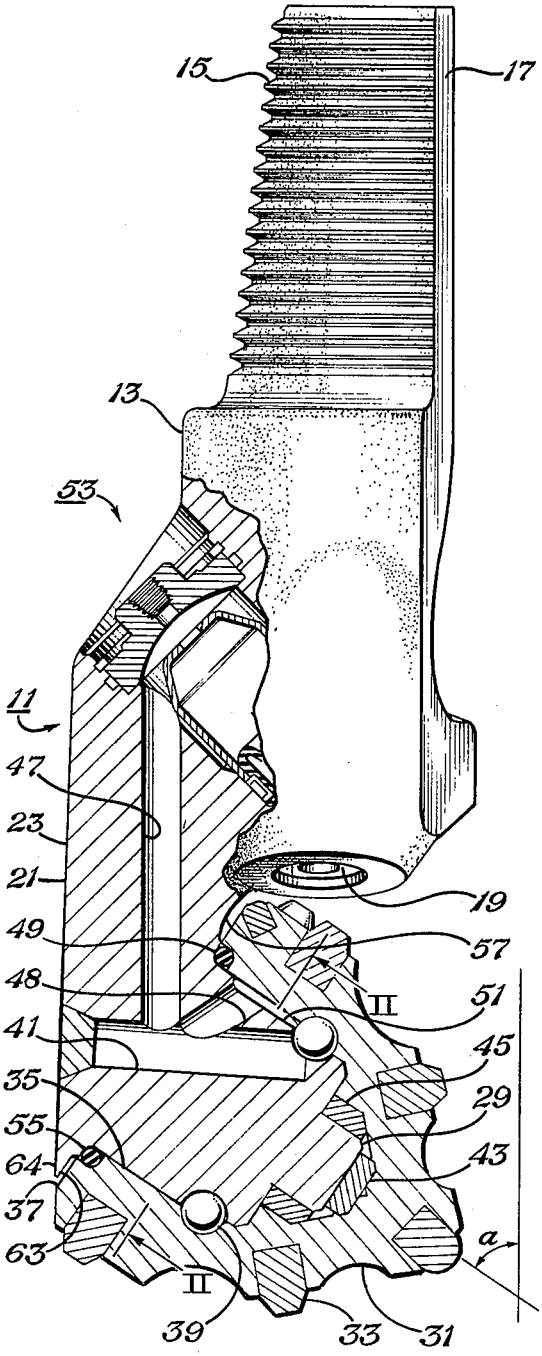
FIG. 1 is a partial vertical sectional view of one third of a drill bit constructed in accordance with this invention.

Referring to FIG. 1, earth boring bit 11 has a body that is made up of three head sections 13 (only one shown). After the head sections 13 are welded together, threads 15 are formed on the upper end for connecting to drill pipe (not shown). An axial passage 17 (only $\frac{1}{3}$ shown) extends into the bit. Three passages (not shown) extend from the bottom of passage 17 and terminates in nozzles 19 (only one shown). Passage 17 and nozzles 19 serve to allow drilling fluid to be pumped from the drill string into the borehole for removing cuttings and cooling the bit.

Figure 2:
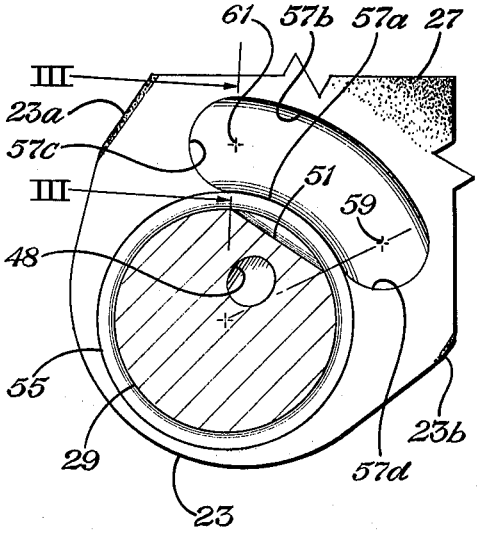
FIG. 2 is a partial sectional view of the part of the drill bit of FIG. 1, taken along the line II—II of FIG. 1, with the cutter and O-ring seal removed.
Figure 3:
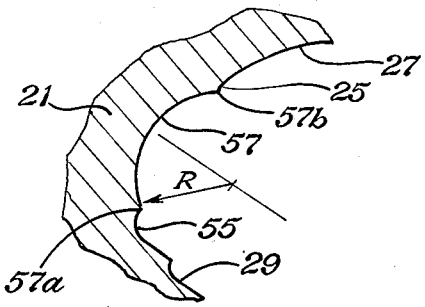
FIG. 3 is a sectional view of part of the drill bit of FIG. 1, taken along the line III—III of FIG. 2.

Each head section 13 has a bit leg 21. Bit leg 21 is an irregularly shaped depending member. It has a curved outer surface 23 with two sides **23*a* and 23*b* (FIG. 2) opposite each other. The inner surface 25 of bit leg 21 extends upwardly to a crotch area 27 (FIG. 3). The crotch area 27 is made up of the bottom surfaces of the three head sections 13, and has, in general, the appearance of a domed ceiling. The crotch area 27 is located directly below passage 17 but is not intersected by passage 17, which terminates above crotch area 27**.

A generally cylindrical bearing pin 29 is formed on the lower end of the bit leg 21. The axis of bearing pin 29 intersects the axis of revolution of bit 11 at an angle a of about 57 degrees. Bearing pin 29 rotatably supports a cutter 31. Cutter 31 has a generally conical exterior with a plurality of cutting elements 33. In the embodiment of FIG. 1, cutting elements 33 comprise sintered tungsten carbide inserts interferingly pressed into holes drilled in the body of cutter 31.

Cutter 31 has a central cavity 35 that mounts on bearing pin 29. Cavity 35 is cylindrical and is surrounded by a backface 37 at the entrance to cavity 35. Backface 37 is a flat annular portion of cutter 31 that is located in a plane perpendicular to the axis of rotation of cutter 31. In the embodiment of FIG. 1, cutter 31 is supported on the bearing pin 29 by what is known as a "journal" bearing. The journal bearing is a friction bearing, with the cylindrical walls of cavity 35 mating with the cylindrical walls of bearing pin 29. A plurality of balls 39 retain cutter 31 on bearing pin 29. Balls 39 are inserted through a ball passage 41 after cutter 31 has been placed over bearing pin 29. A nose button 43 located at the base of cavity 35 and a nose bushing 45 encircling a lower portion of bearing pin 29 absorb forces.

The bearing surfaces between the cutter 31 and bearing pin 29 are lubricated by lubricant transmitted through lubricant passages 47 and 48. An O-ring seal 49 is located at the junction of bearing pin 29 and bit leg 21 for sealing the lubricant from the exterior. A flat surface 51 is formed on the upper, nonpressure side of bearing pin 29 to facilitate lubricant entry into the journal bearing areas from passage 48. A conventional compensator system 53 in communication with passages 47 and 48 reduces the pressure differential between the exterior well bore pressure and the interior lubricant pressure.

The O-ring seal 49 is located in contact with a seal boss 55. As shown in FIG. 3, seal boss 55 is an annular fillet or 90° radius formed between the bit leg 21 and bearing pin 29. The seal boss 55 extends radially outward from bearing pin 29 approximately the radial thickness of O-ring 49. On the upper side of seal boss 55, and on the inner surface 25 of bit leg 21, a depression 57 is formed. When viewed in vertical cross-section as shown in FIGS. 1 and 3, depression 57 is curved, preferably arcuate, and formed at a radius R located on a line parallel with the axis of bearing pin 29. The lower edge 57*a* of depression 57 coincides and is tangent with the upper edge of seal boss 55. The upper edge 57*b* of depression 57 is concentric with the lower edge 57*a*. Upper edge 57*b* terminates near the crotch area 27. The distance between the upper and lower edges 57*a* and 57*b* is considerably greater, preferably at least twice than, the radial thickness of backface 37 of cutter 31. Depression 57 is located behind a portion of backface 37.

The depth of depression 57 is about one fourth its width, the width being the distance from lower edge 57*a* to upper edge 57*b*. Radius R is selected so as to provide this depth. In the preferred embodiment for a 7⅞ inch diameter bit 11, radius R is ⅝ inch and the distance from lower edge 57*a* to upper edge 57*b* is ⅞ inch, resulting in a depth of about 3/16 inch. Referring to FIG. 2, depression 57 does not extend circumferentially around the bearing pin 29, rather is located only on the upper side of the bearing pin. Depression 57 also does not extend completely to the outer surface 23. Instead, the side edges 57*c* and 57*d* of depression 57 are semicircular and formed inward from the outer surface sides 23*a* and 23*b*. The included angle of the arc between the center point 59 of side edges 57*d* and the centerpoint 61 of side edge 57*c* is 60 degrees. An arc extending through center points 59 and 61 on the surface of depression 57 would lie in a single plane perpendicular to the axis of bearing pin 29.

The area below the seal boss 55 on the pressure side of bearing pin 29 is conventional, comprising a shirttail 64, and the last machined surface 63. Last machined surface 63 is a flat surface located in a plane parallel with the plane of cutter backface 37, and extending around the lower side of bearing pin 29. The shirttail 64 is a depending overhanging edge from the bit leg 21.

In operation, bit 11 is rotated, and drilling fluid is pumped down passage 17 to discharge out nozzles 19. As the bit 11 rotates, each cutter 31 rotates on its own axis on each bearing pin 29. Large downward forces are imposed on drill bit 11, normally from the weight of drill collars located above the drill bit. The downward forces create a a high stress at the bit leg—bearing pin juncture.

To reduce cracking in this area, depression 57 provides redistribution of stresses over a large area, lowering peak values as compared to prior art bits.

For the above described depression 57 dimensions in a 7⅞ inch diameter bit, the width of a section in a horizontal plane perpendicular to the bit axis and passing through the bit leg 21 at the top of the upper edge 57*a* of seal boss 57 is about 1½ inches. The width is measured from outer surface 23 to inner surface 25 at a point on the horizontal plane that is intersected by a vertical plane that contains the axis of each bearing pin 29. This vertical plane for one of the bearing pins is the plane of the section of FIG. 1.

The outer surface 23 tapers inwardly when proceeding upwardly at a 2° angle with respect to vertical. At vertical increments of ⅛ inch, proceeding upwardly in a vertical plane from the top of seal boss 55, the widths of the next three horizontal sectional planes are approximately: 1½ inches; 1½ inches; and 1 9/16 inches. The curved depression 57 thus provides a gradual, non-linear increase in section when proceeding upwardly.

In one prior art journal bit of 7⅞ inch diameter, the width of a horizontal sectional plane at the top of seal boss upper edge was also 1½ inches. The last machined surface above the bearing pin was recessed 1/16 inch, had a radial width of ½ inch, and was located in a plane 33° from vertical. At vertical increments of ⅛ inch, proceeding upwardly from the seal boss, the widths of the next three horizontal sectional planes were as follows 1 9/16 inch; 1⅝ inch; 1¾ inch. This is a substantially linear increase of ¼ inch in section over ⅜ inch vertical difference, whereas for the same ⅜ inch vertical difference, the horizontal section of the bit of this invention increased only 1/16 inch.

The invention has significant advantages. The depression reduces the abrupt changes in cross-section, which redistributes the stress over a large area, lowering peak values. The invention is simple and readily adaptable to conventional bits.

While the invention has been shown in only one of its forms, it should be apparent to those skilled in the art that it is not so limited but is susceptible to various changes and modifications without departing from the spirit of the invention.

We claim:

1. In an earth boring bit of the type having multiple bit legs, each bit leg having a depending bearing pin for rotatably carrying a cutter, and an annular fillet formed at the junction at the bearing pin and bit leg, the improvement comprising:

a depression formed in the inside surface of each of the bit legs to relieve stress at the junction, the depression being curved in vertical cross-section and having a lower edge that commences at the top of the fillet; the depression extending circumferentially about the top of the bearing pin and terminating in two discernable side edges, each spaced inward from a side of the bit leg.

2. At an earth boring bit of the type having three bit legs, each bit leg having a depending bearing pin for rotatably carrying a cutter with a central cavity surrounded by an annular backface located in a plane perpendicular to the axis of the cutter, the improvement comprising:

a depression formed in the inside surface of each of the bit legs, commencing behind the backface, the depression being curved in vertical cross-section and having a width in vertical cross-section that is considerably greater than the radial width of the cutter backface; the depression extending circumferentially about the top of the bearing pin and terminating in two discernable side edges, each spaced inward from a side of a bit leg.

3. In an earth boring bit of the type having three bit legs, each bit leg having a depending bearing pin for rotably carrying a cutter, and an annular fillet formed at the junction of the bit leg and bearing pin for receiving a seal ring, the improvement comprising:

a depression formed in the inside surface of each of the bit legs, with a lower edge commencing at the top of the fillet, the depression extending circumferentially less than the distance between the sides of the bit leg.

4. In an earth boring bit having three bit legs, each bit leg having a depending bearing pin for rotatably carrying a cutter, and an annular fillet at the junction of the bearing pin and bit leg for receiving a seal ring, the cutter having a central cavity surrounded by an annular backface located in a plane perpendicular to the axis of the cutter, the improvement comprising:

a depression formed in the inside surface of each of the bit legs, the depression being curved in vertical cross-section and having a lower edge that is adjacent the upper edge of the fillet and behind the backface, the depression extending circumferentially less than the distance between the sides of the bit leg.

* * * * *